United States Patent [19]

Rais et al.

[11] 4,148,472

[45] Apr. 10, 1979

[54] OPERATING TABLE FOR MEDICAL PURPOSES

[75] Inventors: Arnold Rais, Basel; André Lüssi, Ostermundigen, both of Switzerland

[73] Assignee: M. Schaerer A.G., Wabern, Switzerland

[21] Appl. No.: 830,042

[22] Filed: Sep. 2, 1977

[30] Foreign Application Priority Data

May 27, 1977 [CH] Switzerland ..... 6596/77

[51] Int. Cl.[2] ..... F61G 13/00

[52] U.S. Cl. ..... 269/325

[58] Field of Search ..... 269/322–326; 250/439, 445–447

[56] References Cited

U.S. PATENT DOCUMENTS

| | | | |
|---|---|---|---|
| 3,206,188 | 9/1965 | Douglass, Jr. | 269/325 |
| 3,980,288 | 9/1976 | Mitchell et al. | 269/325 |

FOREIGN PATENT DOCUMENTS

| | | | |
|---|---|---|---|
| 997407 | 9/1976 | Canada | 269/325 |

*Primary Examiner*—Robert C. Watson

*Attorney, Agent, or Firm*—McNenny, Pearne, Gordon, Gail, Dickinson & Schiller

[57] ABSTRACT

A frame supporting a combined back-rest and seat of an operating table, together with a saddle-piece projecting from one end of the supporting frame, is disposed upon the head of a supporting column in such a way as to be tiltable in all directions, and supporting parts of a head- and shoulder-rest and of a leg-rest of the operating table are interchangeable, for the purpose of obtaining a wide range of radioscopic capability.

5 Claims, 12 Drawing Figures

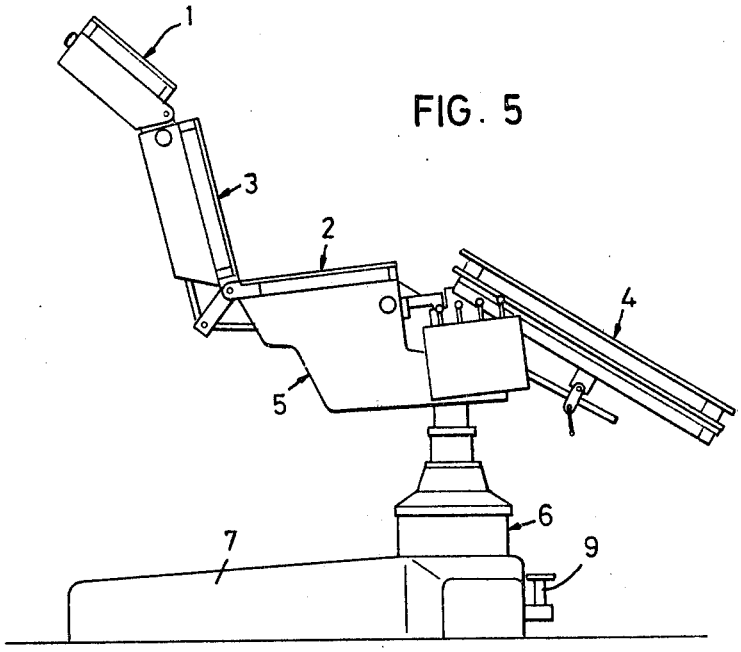
FIG. 5
FIG. 6
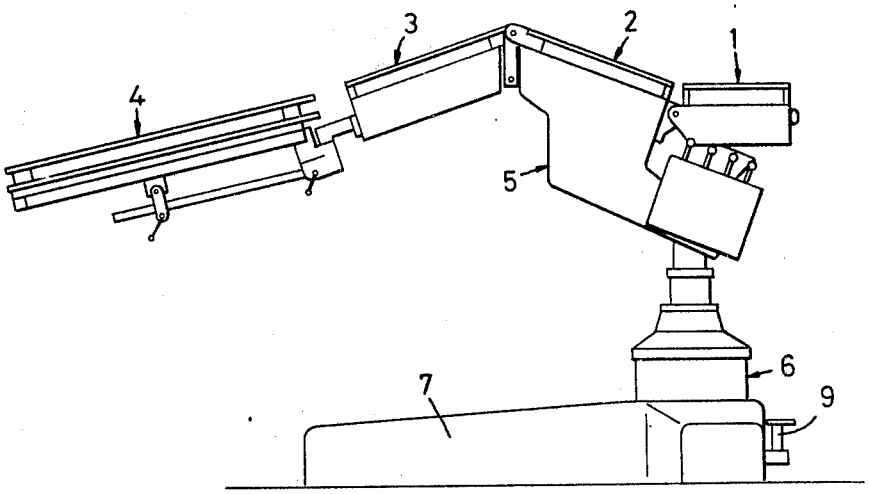

OPERATING TABLE FOR MEDICAL PURPOSES

This invention relates to an operating table for medical purposes, of the type wherein a supporting column supports a body-rest divided into a plurality of successive body-rest portions which are mutually pivotable about transverse axes situated beneath those portions, each of the body-rest portions including a body-rest surface formed by a plate of X-ray-permeable material, and each such plate being supported by support means secured beneath and spaced from the outer edges of the plate.

When operating tables of the foregoing type are used, film cassettes can be pushed in under the plates of X-ray permeable material when X-ray photographs are to be made. The more modern operating rooms, however, are also provided with radioscopic equipment by means of which an X-ray image can be projected onto a pick-up tube at any time during an operation, and this image then appears on the screen of a television monitor. The advantage offered by such equipment is not only that the X-ray image appears instantaneously, but also that the dose of radiation required can be considerably less than for photographs made on film.

It is an object of this invention to provide an improved operating table of the type initially mentioned which, while fully retaining the pivotability of the individual body-rest portions about the transverse axes, increases accessibility for the X-ray pick-up tube to such an extent that depending upon the position of the patient's body on the operating table, there is a complete range of radioscopic capability either from the tips of the toes to the vicinity of the neck, or from the crown of the head to the pelvis.

To this end, in the operating table according to the present invention, the improvement comprises a combined backrest and seat formed by two of the body-rest portions, a support means combination associated with the combined back-rest and seat and comprising first and second pairs of oppositely disposed side parts pivotable with respect to one another about one of the transverse axes situated approximately halfway along the combined back-rest and seat, two adjusting mechanisms respectively disposed on inner sides of the first and second pairs of side parts, a head forming part of the supporting column, and a projecting saddle-piece mounted for pivotal adjustment on the supporting-column head and rigidly connecting one of the pairs of side parts at one end thereof.

Figure 1:
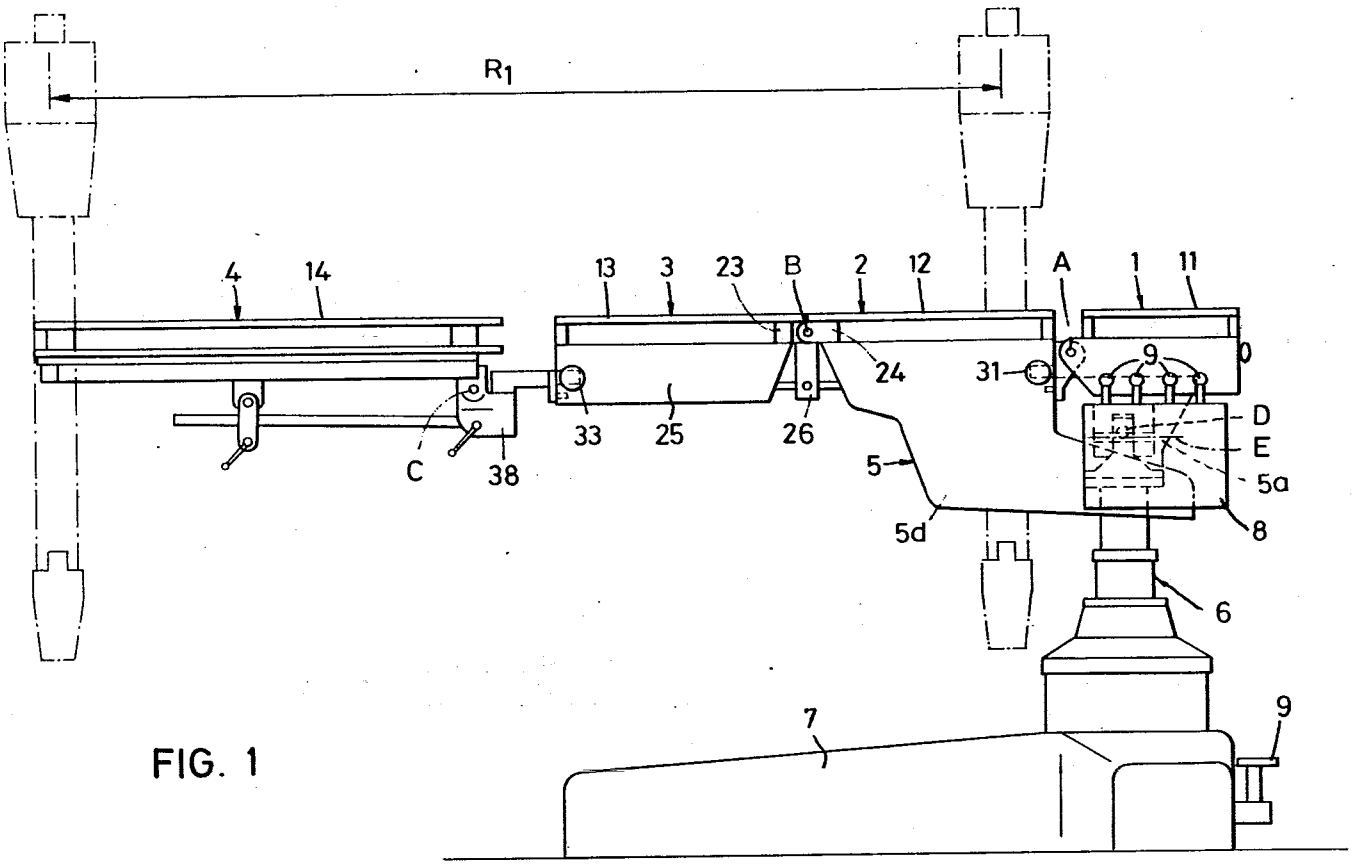
Figure 2:
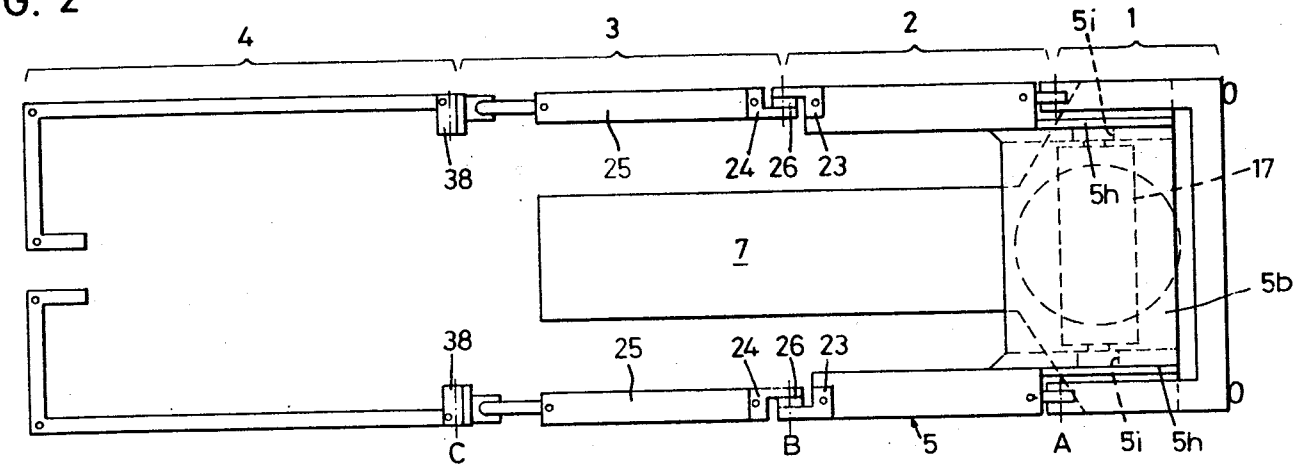
Figure 4:
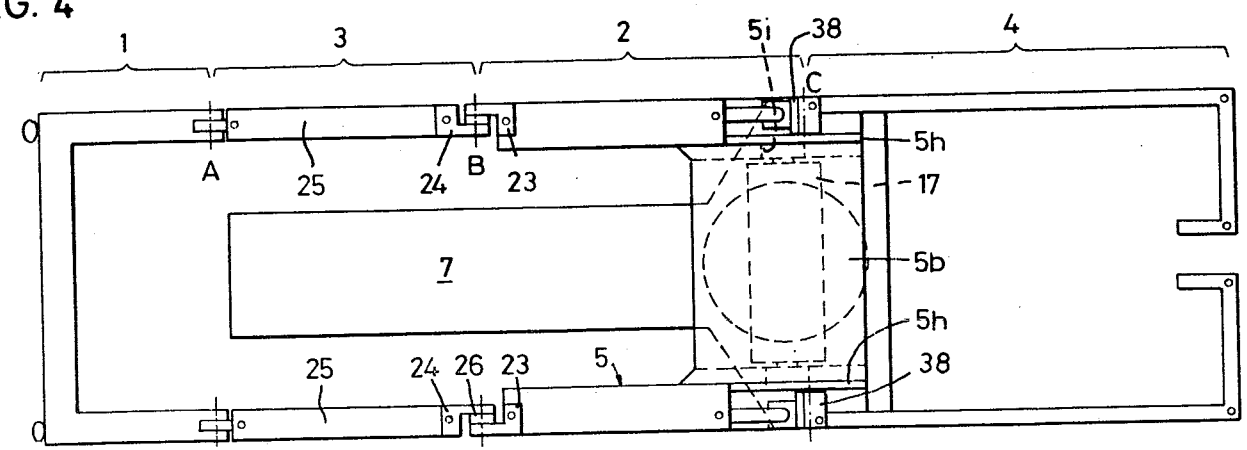
Figure 3:
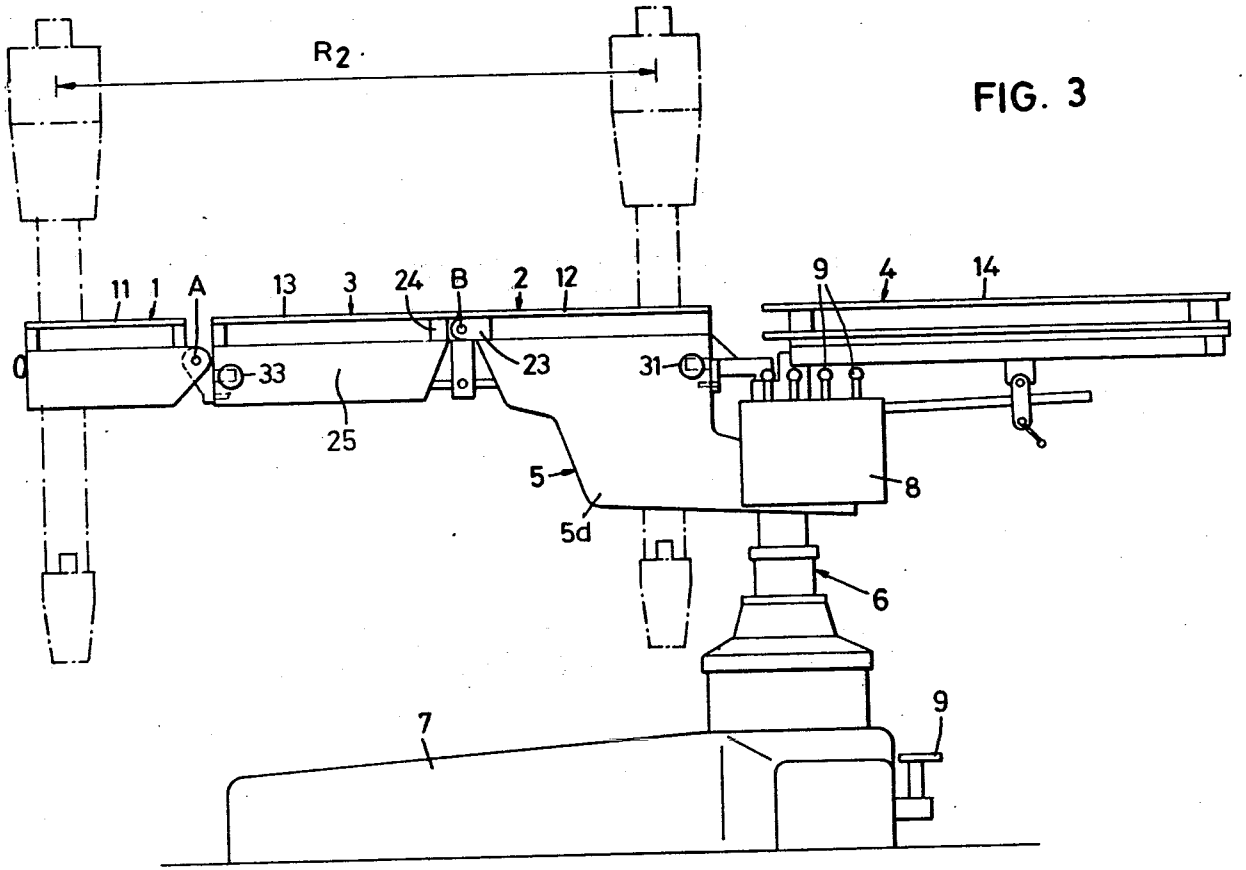
Figure 7:
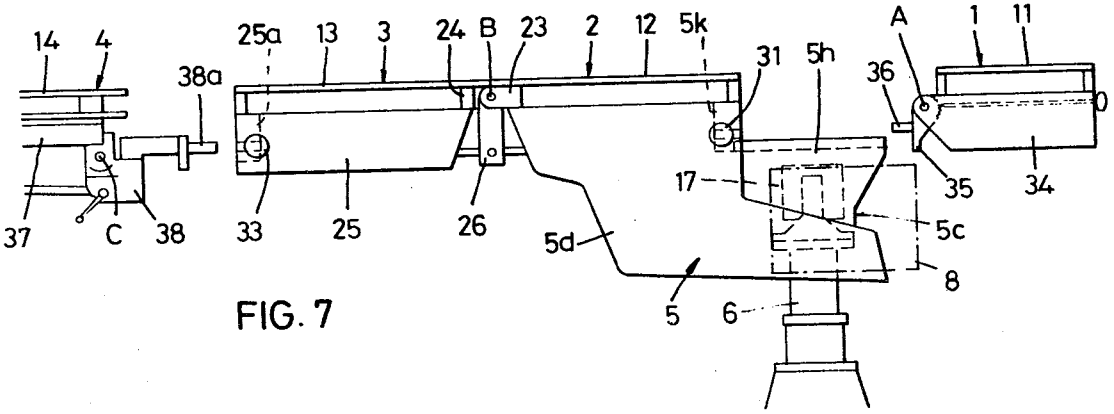
Figure 9:
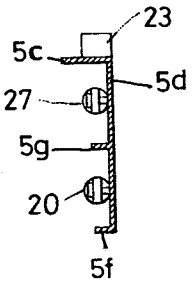
Figure 8:
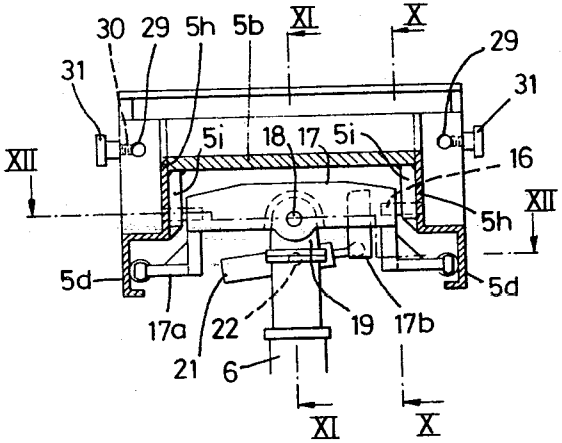
Figure 10:
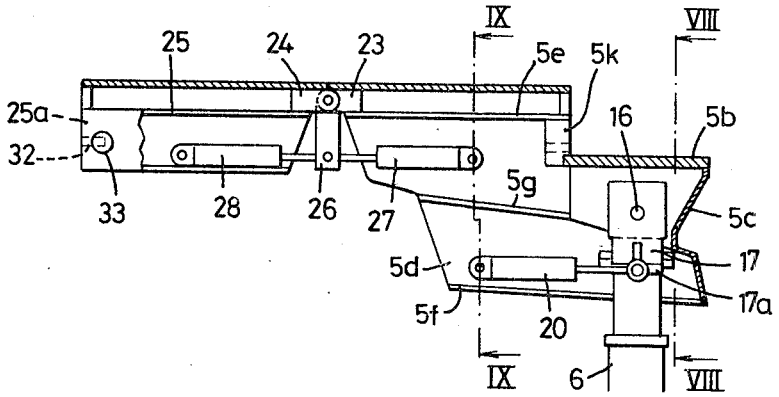
Figure 11:
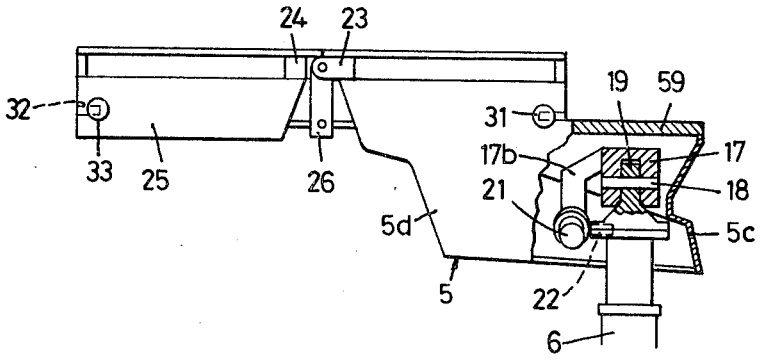
Figure 12:
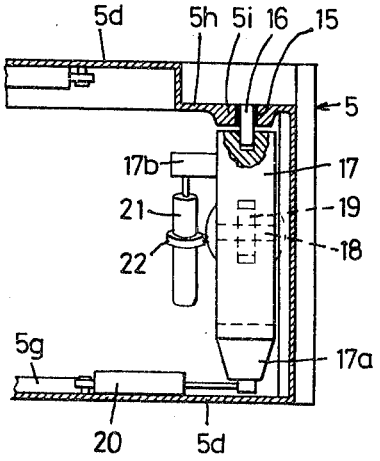

Other objects and advantages of the invention will become apparent from the following detailed description of a preferred embodiment thereof, taken in conjunction with the accompanying drawings, in which:

FIG. 1 is a diagrammatic elevation in which the parts of the operating table are shown in a position in which the range of radioscopic extends from the tips of the toes to the vicinity of the neck of a patient, FIG. 2 is a diagrammatic top plan view corresponding to FIG. 1, FIG. 3 is a diagrammatic elevation in which the parts of the operating table are shown in a mutual position in which the range of radioscopic capability extends from the crown of a patient's head to the pelvic region, FIG. 4 is a diagrammatic top plan view corresponding to FIG. 3, FIGS. 5 and 6 are diagrammatic elevations in which individual portions of the body-rest of the operating table are shown in various mutual pivoting positions such as are utilized in certain operations, FIG. 7 is an elevation of the top of the operating table, with a head- and shoulder-rest and part of a leg-rest being shown as detached, FIG. 8 is a section taken on the line VIII—VIII of FIG. 10, FIG. 9 is a section taken on the line IX—IX of FIG. 10, FIG. 10 is an elevation, partially in a section taken on the line X—X of FIG. 8, illustrating particularly the back-rest and seat shown in elevation in FIG. 7, FIG. 11 is a longitudinal section of part of the back-rest and seat taken on the line XI—XI of FIG. 8, and FIG. 12 is a horizontal section taken on the broken line XII—XII of FIG. 8.

An overall description of the general construction of the operating table according to the invention will first be given with reference to FIGS. 1–6; thereafter, additional details of the design of the operating table will be described with particular reference to FIGS. 7–12.

A body-rest of the operating table, upon which a patient is intended to lie, is divided into several portions 1, 2, 3, 4 which are pivotingly adjustable with respect to one another about transverse axes A, B and C situated just beneath the body-rest surface. Portions 2 and 3 together form a combinded back-rest and seat, at the ends of which portions 1 and 4, viz., a head- and shoulder-rest and a leg-rest, respectively, are interchangeably attached. A supporting frame, designated as a whole by reference numeral 5, comprises a projecting saddle-piece **5*a* situated at the end of the supporting frame remote from portion 3. Saddle-piece 5*a* is mounted for pivotal movement about a transverse axis D and also about a central longitudinal axis E at the top or head of a supporting column 6, which is in turn mounted in a foot 7 in a conventional manner so as to be adjustable in height. Secured to one side of saddle-piece 5*a* is a control panel 8 containing a plurality of valve units which can be operated by hand-levers 9 and which control the supply and withdrawal of pressure fluid to hydraulic cylinders which cause portions 2 and 3 to pivot with respect to one another about axis B, as well as causing portion 2, and hence the entire body-rest, to pivot about axes D and E. Supporting column 6 can be raised and lowered by means of a valve unit (not shown) operated by a pedal 9. A platelike cross member belonging to saddle-piece 5*a* extends in frame 5 approximately up to the root of this saddle-piece, thus yielding — as indicated particularly in FIGS. 1 and 3 — a "free radioscopic range" $R_1$, from the tips of a patient's toes to approximately his neck, or $R_2$, from about the crown of the patient's head to his pelvis, depending upon which way the patient is lying upon the operating table. Owing to the fact that the top part of saddle-piece 5*a* is narrowed, a frame of portion 1, U-shaped in plan, or a similar frame side part (but divided halfway across) of portion 4 can be pivoted downward by about 30 degrees about its axis A or C from the position shown in FIG. 1 or from the position shown in FIG. 2**, respectively.

Besides the positions of portions 1, 2, 3, 4 with a horizontal body-rest surface for a patient, as shown in FIGS. 2–4, and the two positions with portions 1, 2, 3, 4 at angles to one another, as shown in FIGS. 5 and 6, as many other positions as may be desired are also possible, added to which the two cross-halves of leg-rest portion 4 are also pivotally adjustable about longitudinal axes, independently of one another, if need be.

In the individual portions 1, 2, 3, 4 the actual body-rests consist, in a manner known per se, of plates 11, 12, 13 and 14, respectively, of X-ray-permeable material; they may for example be sheets of plastic or slabs of wood coated with synthetic resin. Plates 11–14 are supported on support means associated with the individual portions 1–4, these support means being secured beneath and spaced from the outer edges of the plates so that, if need be, an X-ray film cassette may be slipped into the gaps thus created. The support means are secured in a conventional manner by screws and, if necessary, with the interposition of spacers. Body-rest plates 11–14 have been omitted from FIGS. 3 and 4 in order not to clutter the drawing and in order clearly to illustrate the "free radioscopic range" in the transverse direction as well.

The design of the operating table according to the invention will now be described in greater detail with reference to FIGS. 7–12.

At the location of supporting frame 5 of portion 2, two frame side parts 5*d* are rigidly connected to one another by an upper transverse wall 5*b* and a rear wall 5*c* of projecting saddle-piece 5*a*. Side parts 5*d* are flat on the outside; on the inside, they are stiffened by a longitudinally-running upper flange 5*e* and a longitudinally-running lower flange 5*f*, as well as by a rib 5*g*. Side parts 5*d* extend to below saddle-piece 5*a*, side walls 5*h* of which are offset inwardly for reasons to be explained below. These inner walls 5*h* are additionally reinforced by integrally cast bosses 5*i*. Inset in the double-thickness walls 5*h*, 5*i* formed are bushings 15 in which bearing bolts 16 rotate, which are fixed in opposite ends of a supporting yoke 17. This arrangement enables frame 5 to pivot about transverse axis D. A forked middle portion of yoke 17 is pivotally mounted by means of a bearing bolt 18 about central longitudinal axis E, as is particularly apparent in FIGS. 8 and 11. On each end of yoke 17 there is an outwardly and downwardly projecting extension 17*a*. As may be seen from FIGS. 10 and 12, extensions 17*a* are linked to the piston rods of hydraulic cylinders 20, the other ends of which engage the adjacent side walls 5*d* of frame 5 in order that frame 5 may pivot about transverse axis D. Yoke 17 also comprises a downwardly projecting extension 17*b* which is linked to the end of the piston rod of a hydraulic cylinder 21; the latter is mounted by means of a part 22 on supporting column 6 for pivoting about an axis which is parallel to axis E, i.e., to that of bearing bolt 18, but which is offset downward with respect thereto. By means of cylinder 21, yoke 17 together with frame 5 and the entire body-rest can be made to pivot about longitudinal axis E.

Each side part 5*d* has at its uppermost end, remote from saddlepiece 5*a*, a bearing block 23 secured to the associated flange 5*e*. A similar bearing block 24 is secured to an upper flange of each of two opposing, U-profiled support members 25 which form the sole supporting means of portion 3. On each side of the body-rest, the respective blocks 23 and 24, and a downwardly projecting arm 26, are assembled for pivoting about transverse axis B. As will be particularly apparent from FIG. 7, the lower end of each arm 26 is linked to the piston rods of two hydraulic cylinders 27 and 28, the other ends of which are linked to the adjacent frame side part 5*d* and the adjacent support member 25, respectively. By means of cylinders 27 and 28, portion 3 can be shifted with respect to portion 2 about transverse axis B. Integrally cast onto the upper corner portion of each frame side part 5*d*, adjacent to transverse wall 5*b*, is a boss 5*k* having a smooth-walled longitudinal blind bore 29 and a tapped hole 30 opening into bore 29 from the outside. A setscrew 33 having a grip-head is screwed into hole 30. At the same level, a similar boss 25*a* is integrally cast onto the opposite end of each support member 25 associated with portion 3. Each boss 25*a* has a blind bore 32 of the same diameter as blind bore 29, as well as a tapped hole, opening into bore 32 from the outside, into which there is screwed a setscrew 33 having a grip-head.

Body-rest portion 1 comprises a support member 34, U-shaped in plan, to the ends of the legs of which connecting members 35 are linked for pivoting about transverse axis A. Each member 35 comprises a socket pin 36; these socket pins can be selectively inserted, when the operating table is used as illustrated in FIGS. 1 and 2, into blind bores 29 of bosses 5*k* and fixed there by means of setscrews 31, or, when the operating table is used as illustrated in FIGS. 3 and 4, into blind bores 32 of bosses 25*a* and fixed therein by means of setscrews 33.

Leg-rest portion 4 has two lateral support members 37, substantially L-shaped in plan, to which connecting members 38 are linked for pivoting about transverse axis C. The free end portion of each of the members 38 consists of a socket pin 38*a*; these socket pins can be inserted in blind bores 32 of bosses 25*a* and fixed therein by setscrews 33 when the operating table is used in the manner shown in FIGS. 1 and 2, or they can be inserted instead in blind bores 29 and fixed therein by setscrews 31 when the table is used as shown in FIGS. 3 and 4. Thus, it is not only possible to affix body-rest portions 1 and 4 interchangeably to the ends of combined back-rest and seat portion 2, 3, as mentioned above, but the two separate lateral halves of leg-rest portion 4 can also be adjusted about the axis of socket pins 38*a*, if need be, after setscrews 33 have been loosened somewhat.

Finally, it may be added that the above-mentioned inward offsetting of sidewalls 5*h* of saddle-piece 5*a* with respect to side parts 5*d* makes possible the downward pivoting of the side parts of support member 34 of portion 1 about the axis A from the position shown in FIG. 1, or similarly the downward pivoting of lateral support members 37 of leg-rest portion 4 from the position shown in FIG. 3. The top part of saddle rear wall 5*c* is so inclined that during such a downward pivoting of the head- and shoulder-rest portion 1 attached there, it will not be in the way of the crosspiece of support member 34.

What is claimed is:

1. In an operating table for medical purposes, of the type wherein a supporting column supports a body-rest divided into a plurality of successive body-rest portions which are mutually pivotable about transverse axes situated beneath said portions, each of said portions including a body-rest surface formed by a plate of X-ray-permeable material, and each said plate being supported by support means secured beneath and spaced from the outer edges of said plate, the improvement comprising:

a combined back-rest and seat formed by two of said portions, a U-shaped support means combination associated with said combined back rest and seat and comprising first and second pairs of oppositely disposed spaced side parts pivotable with respect to one another about one of said transverse axes situated approximately halfway along said combined back-rest and seat, said U-shaped support means defining an open X-ray permeable area adjusting means disposed on inner sides of said first and second pairs of side parts for angularly adjusting said side parts relative to each other about said one of said transverse axes, a head forming part of said supporting column, and a projecting saddle-piece mounted for pivotal adjustment on said head and rigidly connecting one of said pairs of side parts at an end remote from said one of said transverse axes to form said U-shaped support means, the axis of said support column being offset from the U-shaped support means and extending outside of said open X-ray permeable area so that the U-shaped support means provides unobstructed radiographic capabilities for the combined back-rest and seat.

2. The operating table of claim 1, further comprising a head- and shoulder-rest formed by one of said body-rest portions, a leg-rest formed by another one of said portions, third and fourth pairs of side parts respectively supporting said head- and shoulder-rest and said leg-rest, two identical pairs of connecting members respectively disposed at one end each of said third and fourth pairs of side parts, and a yoke accommodated in said saddle-piece, wherein said first and second pairs of side parts each comprise at the mutually remote ends thereof identical means for interchangeably attaching said identical pairs of connecting members, said third pair of side parts being adapted to enable pivoting of said head- and shoulder rest about one of said transverse axes, said fourth pair of side parts being adapted to enable pivoting of said leg-rest about another of said transverse axes, said saddle-piece rigidly transversely connecting only said first pair of side parts, being so dimensioned as to allow unimpeded pivoting of a said body-rest portion connected to said combined back-rest and seat by means of said connecting members, and being itself pivotable about both one of said transverse axes and the central longitudinal axis of said operating table by means of said yoke.

3. The operating table of claim 2, wherein said yoke includes a first outwardly projecting extension, said operating table further comprising power means connected to lower portions of said first pair of side parts and to said first extensions for displacement of said saddle-piece about said one of said transverse axes with respect to said yoke.

4. The operating table of claim 3, wherein said yoke further includes a second downwardly projecting extension, said operating table comprising a further power means connected to said second extension and mounted upon said head to pivot about an axis situated beneath and spaced from said central longitudinal axis for displacement of said yoke about said central longitudinal axis with respect to said head.

5. The operating table of claim 4, further comprising two downwardly projecting arms mounted on respective sides of said operating table for pivoting about said one of said transverse axes about which said first and second pairs of side parts are pivotable, said adjusting means being connected at one end thereof to respective lower ends of said arms and at the other end thereof to respective said side parts.

* * * * *